US009714538B2

(12) United States Patent
Huang

(10) Patent No.: US 9,714,538 B2
(45) Date of Patent: Jul. 25, 2017

(54) WINDOW BLIND

(71) Applicant: TAICANG KINGFU PLASTIC MANUFACTURE CO., LTD., Taicang, Jiangshu Province (CN)

(72) Inventor: Szu-Chang Huang, Fusing Township, Changhua County (TW)

(73) Assignee: TAICANG KINGFU PLASTIC MANUFACTURE CO., LTD., Taicang (CN)

( * ) Notice: Subject to any disclaimer, the term of this patent is extended or adjusted under 35 U.S.C. 154(b) by 0 days.

(21) Appl. No.: 15/179,137

(22) Filed: Jun. 10, 2016

(65) Prior Publication Data

US 2016/0333637 A1 Nov. 17, 2016

Related U.S. Application Data

(63) Continuation-in-part of application No. 14/555,812, filed on Nov. 28, 2014, now abandoned.

(30) Foreign Application Priority Data

Mar. 28, 2014 (CN) ..... 2014 2 0147636 U

(51) Int. Cl.
*E06B 9/322* (2006.01)
*E06B 9/38* (2006.01)

(52) U.S. Cl.
CPC ..... *E06B 9/322* (2013.01); *E06B 9/38* (2013.01); *E06B 2009/3222* (2013.01)

(58) Field of Classification Search
CPC .... E06B 9/322; E06B 9/38; E06B 2009/3222; E06B 2009/3225; E06B 2009/3227
USPC ..... 160/170, 171, 176.1 R
See application file for complete search history.

(56) References Cited

U.S. PATENT DOCUMENTS

| | | | |
|---|---|---|---|
| 6,024,154 | A | 2/2000 | Wang et al. |
| 6,149,094 | A | 11/2000 | Afzal |
| 6,289,965 | B1 | 9/2001 | Ruggles |
| 6,571,853 | B1 | 6/2003 | Ciuca |
| 6,644,375 | B2 | 11/2003 | Palmer |
| 6,761,203 | B1 | 7/2004 | Huang |
| 7,281,563 | B2 | 10/2007 | Wu |
| 7,343,957 | B2 | 3/2008 | Lin |

(Continued)

FOREIGN PATENT DOCUMENTS

| | | |
|---|---|---|
| CN | 2604501 Y | 2/2004 |
| DE | 20 2013 105 080 U1 | 12/2013 |
| TW | 363677 | 7/1999 |

*Primary Examiner* — David Purol
(74) *Attorney, Agent, or Firm* — Hamre, Schumann, Mueller & Larson, P.C.

(57) ABSTRACT

A includes upper and lower rails, a blind unit, a reel unit, mounted to the upper rail, two pull cords, a retarding unit mounted to the upper rail, and a ladder-string adjusting unit. The retarding unit includes two retarders each of which includes a bracket, a first retarding shaft mounted to a lateral wall of the bracket, and a rod member mounted to an end wall of the bracket. The ladder-string adjusting unit includes two ladder-string seats respectively mounted to the brackets of the retarders, a connecting rod interconnecting the ladder-string seats, and two ladder strings connected to the blind unit. Each of the ladder-string seats is located above the rod member and the first retarding shaft of the corresponding retarder.

9 Claims, 6 Drawing Sheets

(56) References Cited

U.S. PATENT DOCUMENTS

| | | | | |
|---|---|---|---|---|
| 7,406,995 | B2 | 8/2008 | Huang | |
| 8,863,812 | B2 * | 10/2014 | Lin | E06B 9/262 160/170 |
| 2007/0084569 | A1 | 4/2007 | Lin | |
| 2009/0159219 | A1 | 6/2009 | Wen et al. | |
| 2009/0283223 | A1 | 11/2009 | Liu | |
| 2011/0061823 | A1 | 3/2011 | Lin | |
| 2013/0306776 | A1 | 11/2013 | Lin | |
| 2014/0217142 | A1 | 8/2014 | Lin | |

* cited by examiner

WINDOW BLIND

CROSS-REFERENCE TO RELATED APPLICATION

This application is a continuation-in-part (CIP) of co-pending U.S. patent application Ser. No. 14/555,812, filed on Nov. 28, 2014, which claims priority of Chinese Application No. 201420147636.4, filed on Mar. 28, 2014.

FIELD

The disclosure relates to a shading device, and more particularly to a window blind.

BACKGROUND

Referring to FIG. 1, a conventional window blind disclosed in U.S. Patent Publication no. 2011/0061823 includes an upper rail 1, two roller devices 2 (only one is shown in FIG. 1) disposed or the upper rail 1, two pull cards 3 (only one is shown in FIG. 1) and a blind unit 4. Each of the roller devices 2 includes a bracket 201, and two rollers 202 mounted to the bracket 201. The bracket 201 of each of the roller devices 2 has two end walls 203 spaced apart in a front-rear direction (the front one is omitted in FIG. 1), and each being formed with a plurality open grooves 204, each of which extends downwardly from a top edge of the end wall 203. For each of the roller devices 2, each of the rollers 202 has opposite end portions respectively mounted in an oppositely corresponding pair of the open grooves 204. Each of the pull cords 3 extends around the rollers 202 of a respective one of the roller devices 2, and is connected to the blind unit 4.

The rollers 202 of each of the roller devices 2 are configured to provide a retarding force to the corresponding pull cord 3 when the pull cord 3 is operated to drive movement of the blind unit 4. However, during the operation of each of the pull cords 3, the rollers 202 of the corresponding roller device 2 may move along the corresponding open grooves 204, so that the retarding force provided by the rollers 202 is unsteady. Moreover, since each of the open grooves 204 is formed through the top edge of the corresponding end wall 203, an additional operating module (such as an operating module for operation of a ladder string) can hardly be provided in a space of each of the roller devices 2 located above the rollers 202 thereof.

SUMMARY

Therefore, an object of the disclosure is to provide a window blind that can alleviate at least one of the drawbacks of the prior art.

According to the disclosure, the window blind includes an upper rail, a lower rail, a blind unit, a reel unit, two pull cords, a retarding unit and a ladder-string adjusting unit. The lower rail is located below the upper rail in an altitudinal direction. The blind unit is disposed between the upper and lower rails. The reel unit is disposed on one of the upper and lower rails. Each of the pull cords is connected to the reel unit and the other one of the upper and lower rails. The retarding unit cooperates with the reel unit, and is disposed on the one of the upper and lower rails. The retarding unit includes two retarders that are spaced apart from each other in a lateral direction and that respectively correspond to the pull cords. Each of the retarders includes a bracket, a first retarding shaft that is disposed on the bracket, and a rod member that is disposed on the bracket and that is located between the first retarding shaft and the reel unit in the lateral direction. The bracket of each of the retarders has a bottom wall, two lateral walls that are spaced apart from, each other in the lateral direction and that are connected to the bottom wall, and two end walls that are spaced apart from each other in a front-rear direction and that are connected to the bottom wall. The bottom wall of each of the retarders cooperates with the lateral walls and the end walls of the retarder to define a retaining space thereamong. One of the lateral walls of each of the retarders is distal from the reel unit in the lateral direction. The first retarding shaft of each of the retarders includes a core pin that is mounted to the one of the lateral walls of the retarder distal from the reel unit and that extends in the front-rear direction, and a roller member that is rotatably mounted on the core pin. The rod member of each of the retarders is mounted to the end walls of the retarder. Each of the pull cord extends away from the reel unit and around the roller member of the first retarding shaft of the corresponding retarder, and extends around the rod member of the corresponding retarder. The ladder-string adjusting unit includes two ladder-string seats that are respectively disposed on the brackets of the retarders, a connecting rod that extends in the lateral direction and that interconnects the ladder-string seats, and two ladder strings that are respectively connected to the ladder-string seats. Each of the ladder-string seats is pivotally mounted to the lateral walls of the corresponding retarder, extends in the lateral direction through the retaining space of the corresponding retarder, and is located above the rod member and the first retarding shaft of the corresponding retarder. Each of the ladder strings extends in the altitudinal direction and is connected to the blind unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
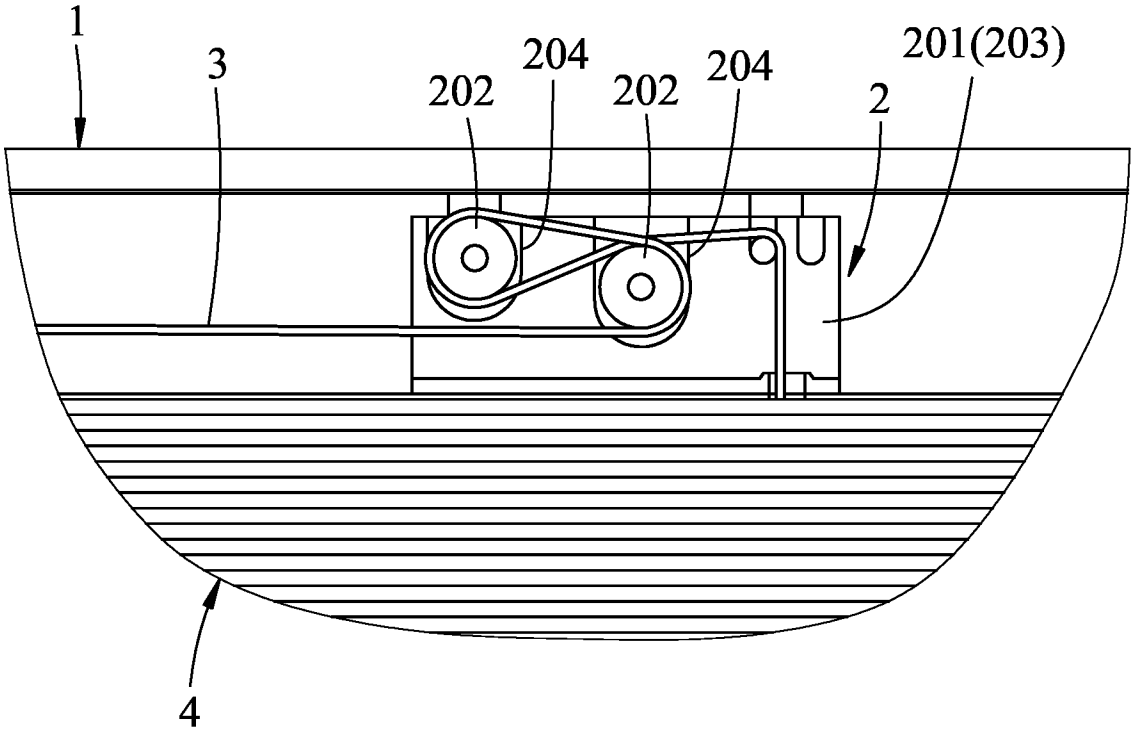
FIG.1 PRIOR ART
FIG. 1 is a fragmentary side view illustrating a conventional window blind disclosed in U.S. Patent Publication No. 2011/0061823.
Figure 2:
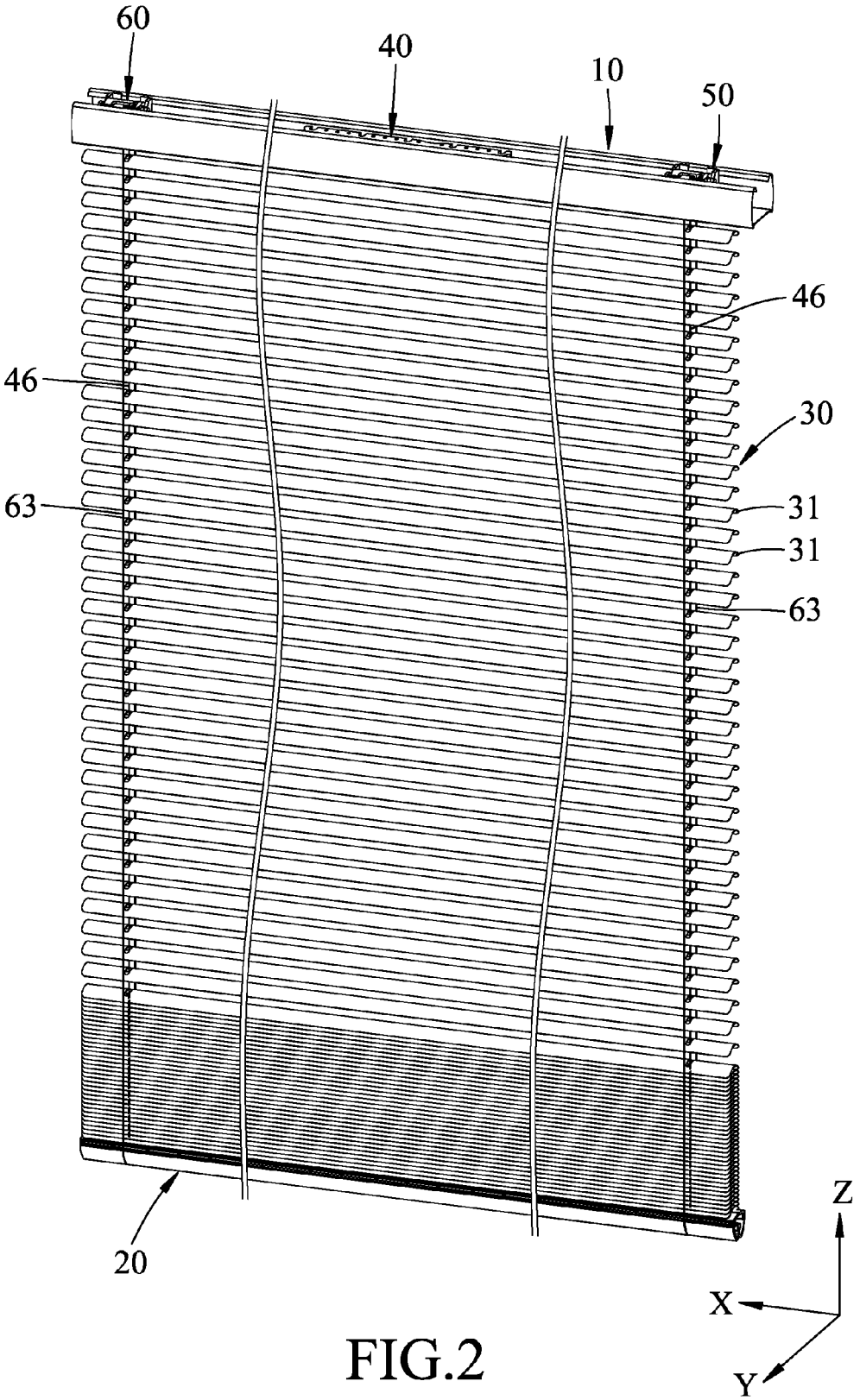
FIG. 2 is a perspective view illustrating an embodiment of the window blind according to the disclosure.
Figure 3:
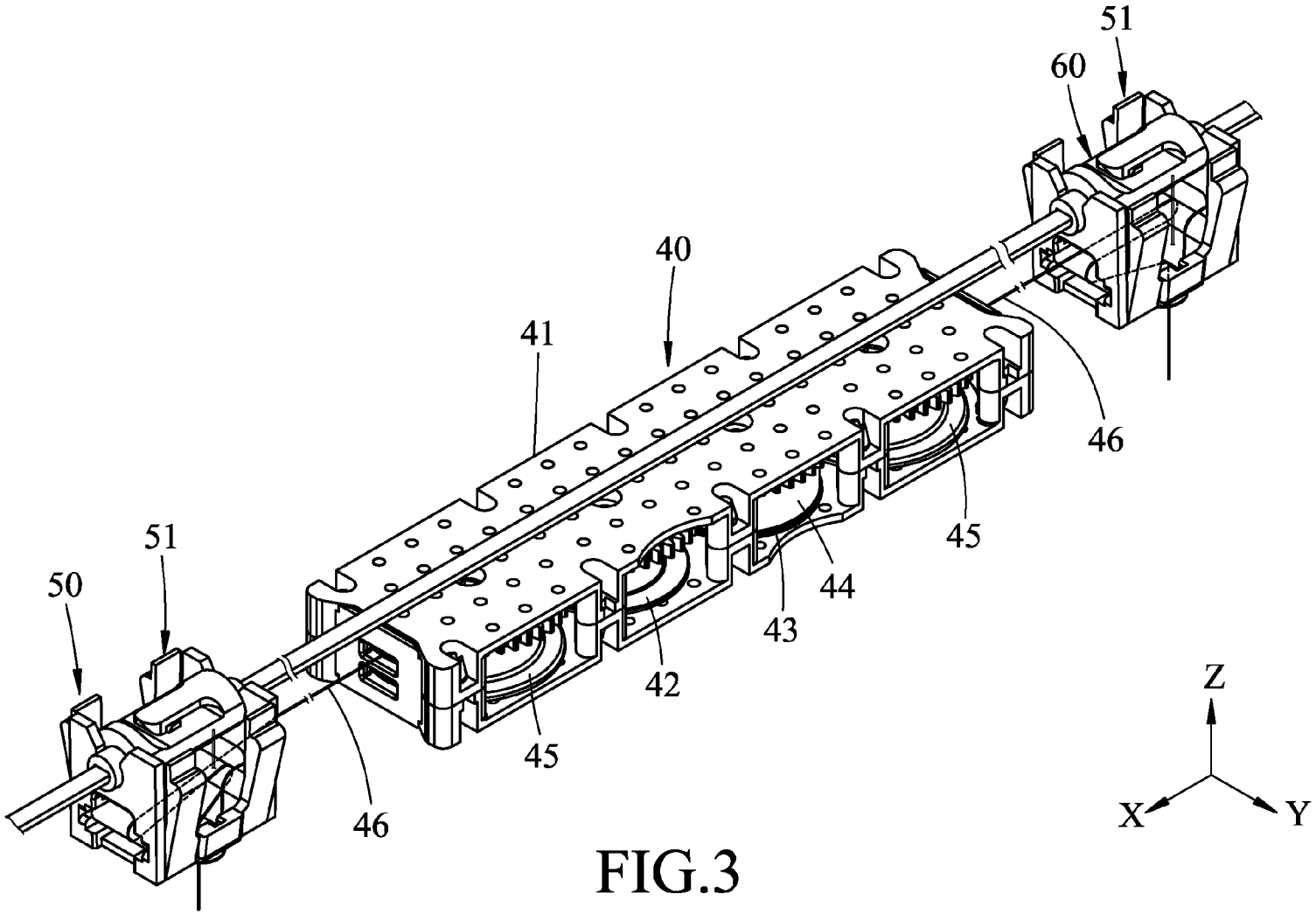
FIG. 3 is a fragmentary perspective view illustrating a reel unit, a retarding unit and a ladder-string adjusting unit of the embodiment.

Referring to FIGS. 2 and 3, the embodiment of the window blind according to the disclosure includes an upper rail 10, a lower rail 20, a blind unit 30, a reel unit 40, two pull cords 46, a retarding unit 50 and a ladder-string adjusting unit 60.

The upper rail 10 is located above the lower rail in an altitudinal direction (Z).

The blind unit 30 is disposed between the upper and lower rails 10, 20. In this embodiment, the blind unit 30 includes a plurality of slats 31.

Figure 4:
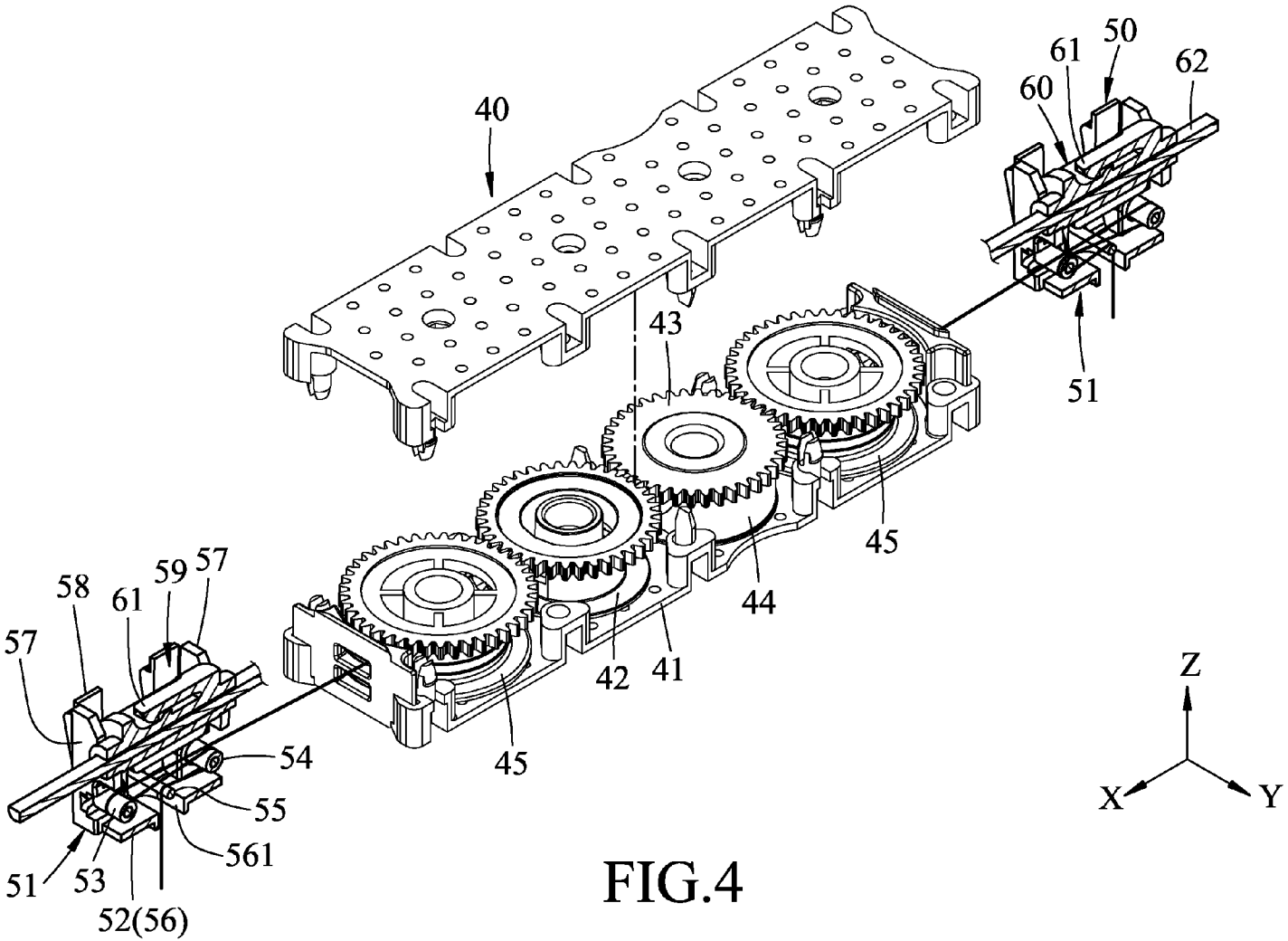
FIG. 4 is an exploded fragmentary perspective view illustrating the reel unit, the retarding unit and the ladder-string adjusting unit.

Referring further to FIG. 4, the reel unit 40 is disposed on the upper rail 10, and includes a casing 41 connected to the upper rail 10, a driving wheel 42 disposed rotatably in the casing 41, a spring reel 43 disposed rotatably in the casing 41 and meshing with the driving wheel 42, a spiral spring 44 having opposite ends that are connected respectively to the driving wheel 42 and the spring reel 43, and two cord reels 45 disposed rotatably in the casing 41 and respectively meshing with the driving wheel 42 and the spring reel 43.

In this embodiment, each of the pull cords 46 is an upper portion connected to a respective one of the cord reels 45, and a lower portion extending through the slats 31 and connected to the lower rail 20.

Figure 5:
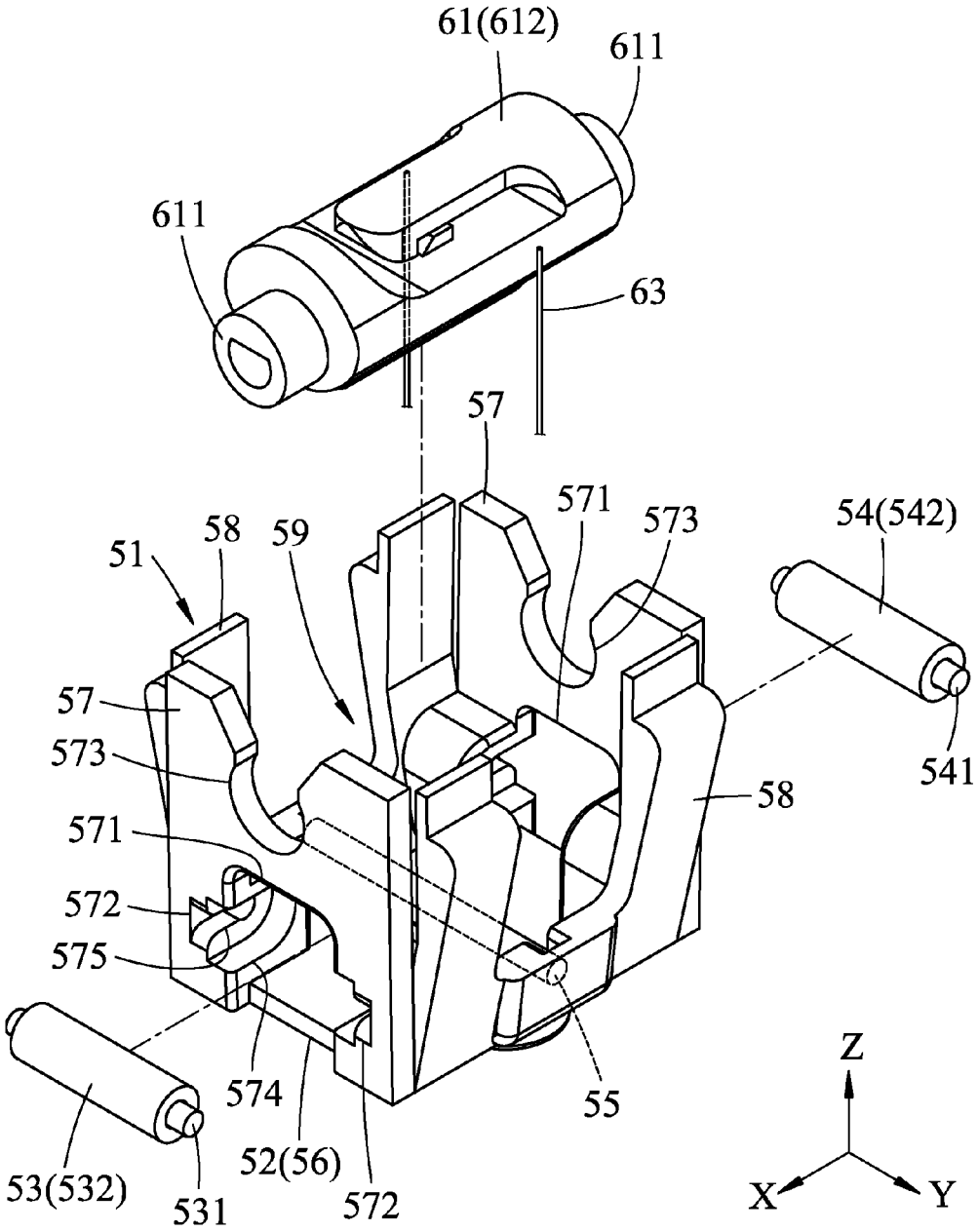
FIG. 5 is an exploded fragmentary perspective view illustrating the retarding unit and the ladder-string adjusting unit.
Figure 6:
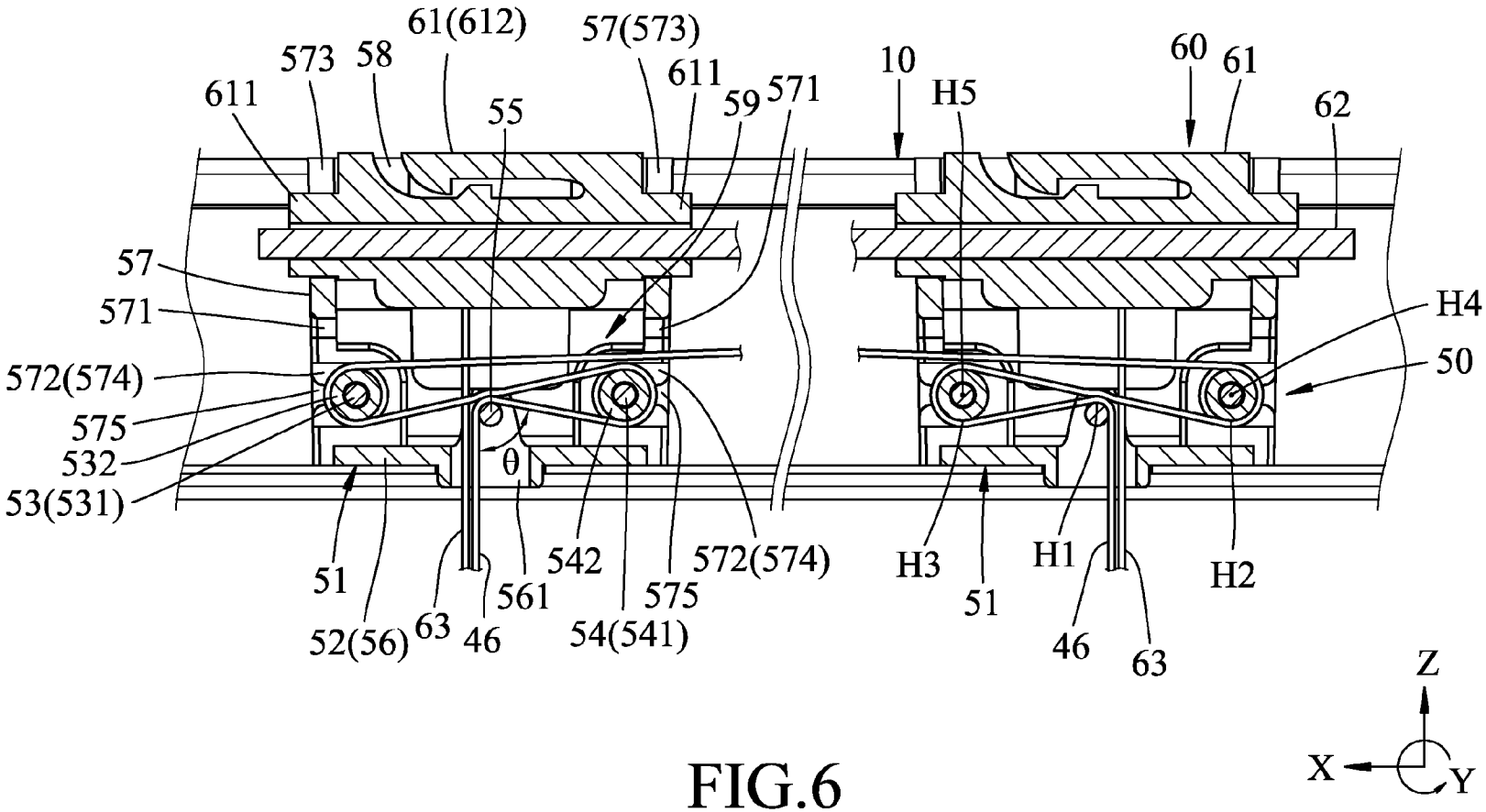
FIG. 6 is a fragmentary sectional view illustrating the retarding unit and the ladder-string adjusting unit.

Referring to FIGS. 4 to 6, the retarding unit 50 cooperates with the reel unit 40, and is disposed on the upper rail 10 (see FIG. 2). The retarding unit 50 includes two retarders 51 that are spaced apart from each other in a lateral direction (X) perpendicular to the altitudinal direction (Z), and that respectively correspond to the pull cords 46. Each of the retarders 51 includes a bracket 52, a first retarding shaft 53 that is disposed on the bracket 52, a second retarding shaft 54 that is disposed on the bracket 52 and that is spaced apart from, the first retarding shaft 53 in the lateral direction (X), and a rod member 55 that is disposed on the bracket 52 and that is located between the first retarding shaft 53 and the reel unit 40 in the lateral direction (X).

For the sake of brevity, only one of the retarders 51 of the retarding unit 50 will be described in the following paragraphs.

The bracket 52 has a bottom wall 56, two lateral walls 57 that are spaced apart from each other in the lateral direction (X) and that are connected to the bottom wall 56, and two end walls 58 that are spaced apart from each other in a front-rear direction (Y) perpendicular to the lateral direct ion (X) and the altitudinal direction (Z) and that are connected to the bottom wall 56. The bottom wall 56 cooperates with the lateral walls 57 and the end walls 58 to define a retaining space 59 thereamong. One of the lateral walls 57 is distal from the reel unit 40 in the lateral direction (X), and the other one of the lateral walls 57 is proximate to the reel unit 40 in the lateral direction (X).

In this embodiment, the bottom wall 56 is formed with a bottom through hole 561 that is in spatial communication with the retaining space 59. Each of the lateral walls 57 is formed with a lateral through hole 571 that is in spatial communication with the retaining space 59, two mounting grooves 572 (only one is shown in FIG. 6) that are spaced apart from each other in the front-rear direction (Y), and an open groove 573 that is located above the later through hole 571 and the mounting grooves 572. For each of the lateral walls 57, each of the mounting grooves 572 has a large groove portion 574 that is in spatial communication with the lateral through hole 571 and the retaining space 59, and a small groove portion 575 that, is in spatial communication, with the large groove portion 574.

The first retarding shaft 53 is mounted to the one of the lateral walls 57 that is distal from the reel unit 40, and includes a core pin 531 that, extends in the front-rear direction (Y), and a roller member 532 that is rotatably mounted on the core pin 531. In this embodiment, the core pin 531 of the first retarding shaft 53 is mounted to the mounting grooves 572 of the one of the lateral walls 57. Preferably, two opposite longitudinal ends of the core pin 531 are respectively mounted in the small groove portions 575 of the mounting grooves 572 of one of the lateral walls 57, and two opposite longitudinal ends of the roller member 532 are respectively retained in the large groove portions 574 of the mounting grooves 572 of the one of the lateral walls 57.

The second retarding shaft 54 is mounted to the other one of the lateral walls 57 that is proximate to the reel unit 40, and includes a core pin 541 that extends in the front-rear direction (Y), and a roller member 542 that is rotatably mounted on the core pin 541. In this embodiment, the core pin 541 of the second retarding shaft 54 is mounted to the mounting grooves 572 of the other one of the lateral walls 57. Preferably, two opposite longitudinal ends of the core pin 541 are respectively mounted in the small groove portions 575 of the mounting grooves 572 of the other one of the lateral walls 57, and two opposite longitudinal ends of the roller member 542 are respectively retained in the large groove portions 574 of the mounting grooves 572 of the other one of the lateral walls 57.

The rod member 55 is mounted to the end walls 58. In this embodiment, the rod member 55 is located between the first and second retarding shafts 53, 54 in the lateral direction (X).

Referring to FIG. 6, in this embodiment, the first and second retarding shafts 53, 54 are identical in altitude. An uppermost point (H1) of the rod member 55 in the altitudinal direction (Z) is higher than a lowermost point (H2) of the roller member 532 of the first retarding shaft 53 and a lowermost point (H3) of the roller member 542 of the second retarding shaft 54 in the altitudinal direction (Z). The uppermost point (H1) of the rod member 55 in the altitudinal direction (Z) is lower than a central point (H4) of the core pin 531 of the first retarding shaft 53 and a central point (H5) of the core pin 541 of the second retarding shaft 54 in the altitudinal direction (Z).

In this embodiment, each of the pull cords 46 first extends away from the reel unit 40 and through the lateral through hole 571 of the other one of the lateral walls of the corresponding retarder 51, then bends downwardly to extend around the roller member 532 of the first retarding shaft 53 of the corresponding retarder 51 and extends toward the reel unit 40, bends downwardly to extend around the roller member 542 of the second retarding shaft 54 of the corresponding retarder 51 and extends away from the reel unit 40, and finally bends downwardly to extend around the rod member 55 of the corresponding retarder 51 and extends out of the corresponding retarder 51 through the bottom through hole 561 of the bottom wall 56.

Referring to FIGS. 2, 5 and 6, the ladder-string adjusting unit 60 includes two ladder-string seats 61 that are respectively disposed on the brackets 52 of the retarders 51, a connecting rod 62 that extends in the lateral direction (X) and that interconnects the ladder-string seats 61, and two ladder strings 63 that are respectively connected to the ladder-string seats 61.

Each of the ladder-string seats 61 is pivotally mounted to the lateral walls 57 of the corresponding retarder 51, extends in the lateral direction (X) through the retaining space 59 of the corresponding retarder 51, and is located above the rod member 55 and the first and second retarding shafts 53, 54 of the corresponding retarder 51. In this embodiment, each of the ladder-string seats 61 has two opposite pivoted axle portions 611 (see FIG. 5), and a main portion 612 connected between the pivoted axle portions 611. The pivoted axle portions 611 of each of the ladder-string seats 61 are respectively and rotatably mounted to the open grooves 573 of the lateral walls 57 of the corresponding retarder 51.

Each of the ladder strings 63 extends in the altitudinal direction (Z) and interconnects the slats 31 of the blind unit 30. In this embodiment, each of the ladder strings 63 has a top end connected to the main portion 612 of the corresponding ladder-string seat 61.

By such, each of the retarders 51 is able to provide a steady retarding force during the movement of the pull cords 46 for operation of the blind unit 30.

The advantages of this disclosure are as follows:

1. For each of the retarders 51, each of the first and second retarding shafts 53, 54 is mounted to the mounting grooves 572 of the corresponding lateral wall 57, and is configured to not move in the altitudinal direction (Z) during the movement of the pull cords 46, so as to provide a steady retarding force to retard the movement of the corresponding pull cord 46.

2. Each of the first and second retarding shafts 53, 54 is mounted into the mounting grooves 572 of the corresponding lateral wall 57 in the lateral direction (X), so that the installation of each of the first and second retarding shafts 53, 54 is relatively convenient.

3. Each of the ladder-string seats 61 of this disclosure is pivotally mounted to the lateral walls 57 of the corresponding retarder 51, located above the first and second retarding shafts 53, 54 of the corresponding retarder 51, and extends through the retaining space 59 of the corresponding retarder 51. Therefore, each of the ladder-string seats 61 is configured to not obstruct the installation of each of the first and second retarding shafts 53, 53 of the corresponding retarder 51 (each of the first and second retarding shafts 53, 54 is mounted into the mounting grooves 572 of the corresponding lateral wall 57 in the lateral direction (X)), and need not occupy an additional space in the upper rail 10.

4. By virtue of the arrangement of the rod member 55 and the first and second retarding shafts 53, 54 of each of the retarders 51, each of the pull cords 46 extends around the corresponding rod member 55 to form an angle (θ, see FIG. 6) that is smaller than 90 degrees to thereby enlarge a contact range between the pull cord 46 and the corresponding rod member 55, so that a relatively large retarding force is generated between the pull cord 46 and the corresponding rod member 55 for retarding the operation of the blind unit 30. Therefore, the blind unit 30 of this disclosure is permitted to be relatively heavy.

It should be noted that, in a variation of the embodiment, the second retarding shaft 54 of each of the retarders 51 is omitted. Each of the pull cords 46 extends away from the reel unit 40, bends downwardly to extend around the roller member 532 of the first retarding shaft 53 of the corresponding retarder 51 and extends toward the reel unit 40, and bends downwardly to extend around the rod member 55 of the corresponding retarder 51.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also foe appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A window blind comprising:

an upper rail;

a lower rail located below said upper rail in an attitudinal direction;

a blind unit disposed between said upper and lower rails;

a reel unit disposed on one of said upper and lower rails;

two pull cords each being connected to said reel unit and the other one of said upper and lower rails;

a retarding unit cooperating with said reel unit, and disposed on the one of said upper and lower rails, said retarding unit including two retarders that are spaced apart from each other in a lateral direction and that respectively correspond to said pull cords, each of said retarders including a bracket, a first retarding shaft that is disposed on said bracket, and a rod member that is disposed on said bracket and that is located between said first retarding shaft and said reel unit in the lateral direction, said bracket of each of said retarders having a bottom wall, two lateral walls that are spaced apart from each other in the lateral direction and that are connected to said bottom wall, and two end walls that are spaced apart from each other in a front-rear direction and that are connected to said bottom wall, said bottom wall of each of said retarders cooperating with said lateral walls and said end walls of said retarder to define a retaining space thereamong, one of said lateral walls of each of said retarders being distal from said reel unit in the lateral direction, said first retarding shaft of each of said retarders including a core pin that is mounted to the one of said lateral walls of said retarder distal from said reel unit and that extends in the front-rear direction, and a roller member that is rotatably mounted on said core pin, said rod member of each of said retarders being mounted to said end walls of said retarder, each of said pull cord extending away from said reel unit and around said roller member of said first retarding shaft of the corresponding retarder, and extending around said rod member of the corresponding retarder; and a ladder-string adjusting unit including two ladder-string seats that are respectively disposed on said brackets of said retarders, a connecting rod that extends in the lateral direction and that interconnects said ladder-string seats, and two ladder strings that are respectively connected to said ladder-string seats, each of said ladder-string seats being pivotally mounted to said lateral walls of the corresponding retarder, extending in the lateral direction through said retaining space of the corresponding retarder, and being located above said rod member and said first retarding shaft of the corresponding retarder, each of said ladder strings extending in the altitudinal direction and being connected to said blind unit.

2. The window blind as claimed in claim 1, wherein the one of said lateral walls of each of said retarders that is distal from said reel unit is formed with a lateral through hole that is in spatial communication with said retaining space of said retarder, and two mounting grooves that are spaced apart from each other in the front-rear direction and that are in spatial communication with said lateral through hole and said retaining space of said retarder, said core pin of each of said retarders being mounted to said mounting grooves of the one of said lateral walls of said retarder.

3. The window blind as claimed in claim 2, wherein said bottom wall of said bracket of each of said retarders is formed with a bottom through hole that is in spatial communication with said retaining space of said retarder, each of said retarder further including a second retarding shaft that is mounted to said bracket of said retarder and that is spaced apart from said first retarding shaft of said retarder in the lateral direction, said rod member of each of said retarders being located between said first and second retarding shafts of said retarder in the lateral direction, the other one of said lateral walls of each of said retarders being proximate to said reel unit, and being formed with a lateral through hole that is in spatial communication with said retaining space of said retarder, and two mounting grooves that are spaced apart from each other in the front-rear direction and that are in spatial communication with said lateral through hole and said retaining space of said retarder, said second retarding shaft of each of said retarders including a core pin that is mounted to said mounting grooves of the other one of said lateral walls of said retarder and that extends in the front-rear direction, and a roller member that is rotatably mounted on said core pin, each of said pull cords first extending away from said reel unit and through said lateral through hole of the other one of said lateral walls of the corresponding retarder, then bending downwardly to extend around said roller member of said first retarding shaft of the corresponding retarder and extending toward said reel unit, bending downwardly to extend around said roller member of said second retarding shaft of the corresponding retarder and extending away from said reel unit, and finally bending downwardly to extend around said rod member of the corresponding retarder and extending out of the corresponding retarder through said bottom through hole of said bottom wall.

4. The window blind as claimed in claim 3, wherein said first and second retarding shaft are identical in altitude.

5. The window blind as claimed in claim 4, wherein, for each of said retarders, an uppermost point of said rod member in the altitudinal direction is higher than a lowermost point of said roller member of said first retarding shaft and a lowermost point of said roller member of said second retarding shaft in the altitudinal direction, said uppermost point of said rod member in the altitudinal direction being lower than a central point of said core pin of said first retarding shaft and a central point of said core pin of said second retarding shaft in the altitudinal direction.

6. The window blind as claimed in claim 3, wherein, for each of said retarders, each of said mounting grooves has a large groove portion that is in spatial communication with the corresponding lateral through hole and the retaining space of said retarder, and a small groove portion that is in spatial communication with said large groove portion, said core pin of said first retarding shaft having two opposite longitudinal ends that are respectively mounted in said small groove portions of said mounting grooves of the one of said lateral walls, said roller member of said first retarding shaft having two opposite longitudinal ends that are respectively retained in said large groove portions of said mounting grooves of the one of said lateral walls, said core pin of said second retarding shaft having two opposite longitudinal ends that are respectively mounted in said small groove portions of said mounting grooves of the other one of said lateral walls, said roller member of said second retarding shaft having two opposite longitudinal ends that are respectively retained in said large groove portions of said mounting grooves of the other one of said lateral walls.

7. The window blind as claimed in claim 3, wherein, for each of said retarders, each of said lateral walls is further formed with an open groove that is located above said later through hole and said mounting grooves of said lateral wall, each of said ladder-string seats having two opposite pivoted axle portions, and a main portion connected between said pivoted axle portions, said pivoted axle portions of each of said ladder-string seats being respectively and rotatably mounted to said open grooves of said lateral walls of the corresponding retarder, each of said ladder-string seats being located above said rod member and said first and second retarding shafts of the corresponding retarder, each of said ladder strings being connected to said main portion of the corresponding ladder-string seat.

8. The window blind as claimed in claim 1, wherein said reel unit is disposed on said upper rail, each of said pull cords having a lower portion that is connected to said lower rail.

9. The window blind as claimed in claim 1, wherein said blind unit includes a plurality of slats.

* * * * *